US005957054A

United States Patent [19]

Olawsky et al.

[11] Patent Number: 5,957,054

[45] Date of Patent: Sep. 28, 1999

[54] METHOD FOR DAMPENING A PRINTING FORM FOR OFFSET PRINTING

[75] Inventors: Klaus Olawsky, Weinheim; Rudi Junghans, Wilhelmsfeld, both of Germany

[73] Assignee: Heidelberger Druckmaschinen AG, Heidelberg, Germany

[21] Appl. No.: 08/954,955

[22] Filed: Oct. 21, 1997

[30] Foreign Application Priority Data

Oct. 21, 1996 [DE] Germany ..... 196 43 354

[51] Int. Cl.[6] ..... B41C 33/00

[52] U.S. Cl. ..... 101/483; 101/451

[58] Field of Search ..... 101/483, 450.1, 101/451, 147, 148

[56] References Cited

U.S. PATENT DOCUMENTS

| | | | |
|---|---|---|---|
| 4,724,764 | 2/1988 | Macphee et al. | 101/451 |
| 4,981,077 | 1/1991 | Alvarez | 101/148 |
| 4,991,502 | 2/1991 | Akao | 101/148 |
| 5,148,747 | 9/1992 | Rodi et al. | 101/450.1 |
| 5,493,970 | 2/1996 | Stoffler et al. | 101/483 |
| 5,520,113 | 5/1996 | Joss et al. | 101/148 |
| 5,568,769 | 10/1996 | Louerer | 101/450.1 |

FOREIGN PATENT DOCUMENTS

| | | |
|---|---|---|
| 1 940 661 | 7/1973 | Germany . |
| 82 04 506 U | 8/1982 | Germany . |
| 38 43 473 C2 | 2/1996 | Germany . |

OTHER PUBLICATIONS

Japanese Patent Application No. 7–164619, dated Jun. 27, 1995, fuzzy–based dampening solution controller.

*Primary Examiner*—Edgar Burr
*Assistant Examiner*—Anthony H. Nguyen
*Attorney, Agent, or Firm*—Herbert L. Lerner; Laurence A. Greenberg

[57] ABSTRACT

A method for dampening a printing form for offset printing wherein a quantity of dampener applied to the printing form by transfer rollers is controlled by adjusting the rpm of one of the transfer rollers in accordance with the rotary angle position of a channel or gap of a form cylinder carrying the printing form includes periodically varying the rpm of at least one of the transfer rollers during each revolution of the form cylinder.

2 Claims, 3 Drawing Sheets

1
2
7
8
9
10
3
13
14
15
18
M
19
φ
17
φ = 0
12
4
11
16
6
5
5.1
20
control unit
22
φ1
φ2
densitometer
21

Printing Start
Printing End
Printing Start
Printing End
Printing Channel or Gap
Printing Channel or Gap
24
23
K^th Rotation
(K+1)^th Rotation
Rotary Speed n in RPM of the metering roller 13
n max
n min
Dampener Film Thickness s in µm
1.6
1.5
1.4
1.3
0
90
180
270
360
450
540
630
720
Rotary angle φ degrees of the form cylinder 5
φ1 = 290° φ2 = 350°
φ1+360° φ2+360°

METHOD FOR DAMPENING A PRINTING FORM FOR OFFSET PRINTING

BACKGROUND OF THE INVENTION

Field of the Invention

The invention relates to a method for dampening a printing form for offset printing wherein a quantity of dampener applied to the printing form by transfer cylinders is controlled by adjusting the rate of rotation or rpm of one of the transfer cylinders in accordance with the rotary angle position of a channel or gap of a form cylinder carrying the printing form.

In German Utility Model DE 82 04 506 U1, an offset rotary printing press with a device for interrupting dampener feed is described, which is supposed to prevent local overdampening of a printing plate clamped to a plate cylinder formed with a channel or gap. When applying dampener to the printing plate with the aid of transfer cylinders, no dampener is dispensed from the transfer cylinder while there is a continuous transfer of dampener during the passage through or over the channel or gap. The quantity of dampener stored on the transfer cylinder is transferred to the next channel region of the printing plate, as viewed in the direction of rotation of the plate cylinder, due to which the aforementioned overdampening can occur. According to this German utility model, a control unit synchronized with the rotation of the plate cylinder is provided which, with the aid of control elements, causes the dampener feed to be interrupted in the channel region. Provided as a control element is a control cylinder, which causes a transfer cylinder, in a defined rotary angle region of the plate cylinder, to be lifted away from a dampener applicator cylinder periodically for each revolution of the plate cylinder. A disadvantage of this construction is that, by the engagement and disengagement of the transfer cylinder, mechanical impacts occur in the printing press which have a disadvantageous effect upon the printing quality.

In a modified form or variant of the foregoing embodiment embodiment disclosed in the German utility model, a blower device having an air flow which is directed towards a transfer cylinder for dampener is triggered likewise in a defined rotary angle region. The blown air causes a retention of the dampener located on the surface of the transfer cylinder. The effect of the flow of blown air is reduced if a high printing speed is realized. Moreover, with this construction, the danger arises that dampener will be randomly detached from the surface of the transfer cylinder by the air flow.

In the constructions according to the foregoing German Utility Model DE 82 04 506 U1, the control cylinder and the blower device, respectively, are controlled by a control cam. The control cam has a fixed control characteristic. There is no possibility of adapting it to the demand for dampener which is dependent upon the printed image.

An inking unit disclosed in the published German Patent Document DE 38 43 473 C2 operates so as to interrupt the transport of dampener during passage through the cylinder channel or gap; this is effected with a stripper or scraper which can be raised and lowered from a dampener applicator cylinder as a function of the rotary angle of the plate cylinder. Once again, mechanical impacts can impair the printing quality.

In German Patent 19 40 661 and in the published Japanese Patent Document JP 7-164 619 A, dampening units for offset printing presses are described wherein a transfer cylinder for dampener or dampening fluid is coupled with a motor. The rotary speed or rpm of the motor is adjustable as a function of the demand for dampener on a printing form. The transfer cylinder connected to the motor can thereby rotate at a different rotary speed or rpm from that of the adjacent cylinders which are in rolling contact with the transfer cylinder. The quantity of dampener transferred can be regulated by the slip existing between the transfer cylinders.

In these heretofore known constructions, only fluctuations in dampener on the surface of the printing form which occur over a relatively large number of printing operations are compensated for. The fluctuations in dampener occurring due to the cylinder channel or gap formed in the printing-form cylinder are not compensated for.

SUMMARY OF THE INVENTION

It is accordingly an object of the invention to provide a method for dampening a printing form which avoids overdampening of the printing form is avoided, and has no mechanical effects which would otherwise impair printing quality.

With the foregoing and other objects in view, there is provided, in accordance with the invention, a method for dampening a printing form for offset printing wherein a quantity of dampener applied to the printing form by transfer rollers is controlled by adjusting the rpm of one of the transfer rollers in accordance with the rotary angle position of a channel or gap of a form cylinder carrying the printing form, which comprises periodically varying the rpm of at least one of the transfer rollers during each revolution of the form cylinder.

In accordance with another mode, the method includes rotating the one transfer roller with maximum rpm in the region of the printing form corresponding to the beginning of printing of a printed image, and with a minimum rpm in a region of the printing form located upstream of the channel or gap in the direction of rotation of the form cylinder.

Because the speed of the transfer roller is varied during each revolution of the form cylinder, it is possible to avoid a regional excess of dampener on the printing form. Consequently, there are no annoying stripes or lightened locations in the printed image that are due to a nonhomogeneous distribution of dampener in an emulsion formed of dampener and printing ink.

In a dampening unit wherein three transfer rollers are provided for transferring the dampener from a dampener supply container to the printing form, overdampening of the printing form can be effectively compensated for by rolling off on channels, if the rpm of the second transfer roller, acting as a metering roller, is periodically reduced by a given amount, offset by the distance of the circumferential length of the gap between this metering roller and the transfer roller applying the dampener to the printing form to the gap between the transfer roller applying the dampener to the printing form, and the printing form.

Moreover, with the method according to the invention, the arrival of an excessively large amount of dampener in the associated inking unit is prevented.

In a variant mode of the method, the rpm of at least one transfer roller is varied not only in accordance with the length of a channel or gap formed in the printing form cylinder but also in accordance with the distribution of ink layer thickness in the printed image. Consequently, not only is overdampening of the printed form avoided by the rolling off on the channel or gap, but also those regions of the printing form that tend toward scumming are supplied with more dampener. Such regions occur particularly at the onset of printing. In such a case, it is advantageous if the rpm of the transfer roller has a maximum value in the region of the printing form which corresponds to the start of printing of a printed image, and a minimum value in the region of the printing form located in the rotary direction upstream of the channel, gap or pit.

Other features which are considered as characteristic for the invention are set forth in the appended claims.

Although the invention is illustrated and described herein as embodied in a method for dampening a printing form for offset printing, it is nevertheless not intended to be limited to the details shown, since various modifications may be made therein without departing from the spirit of the invention and within the scope and range of equivalents of the claims.

The method of operation of the invention, however, together with additional objects and advantages thereof will be best understood from the following description of specific modes and embodiments when read in connection with the accompanying drawings, wherein:

DESCRIPTION OF THE PREFERRED EMBODIMENTS

Figure 1:
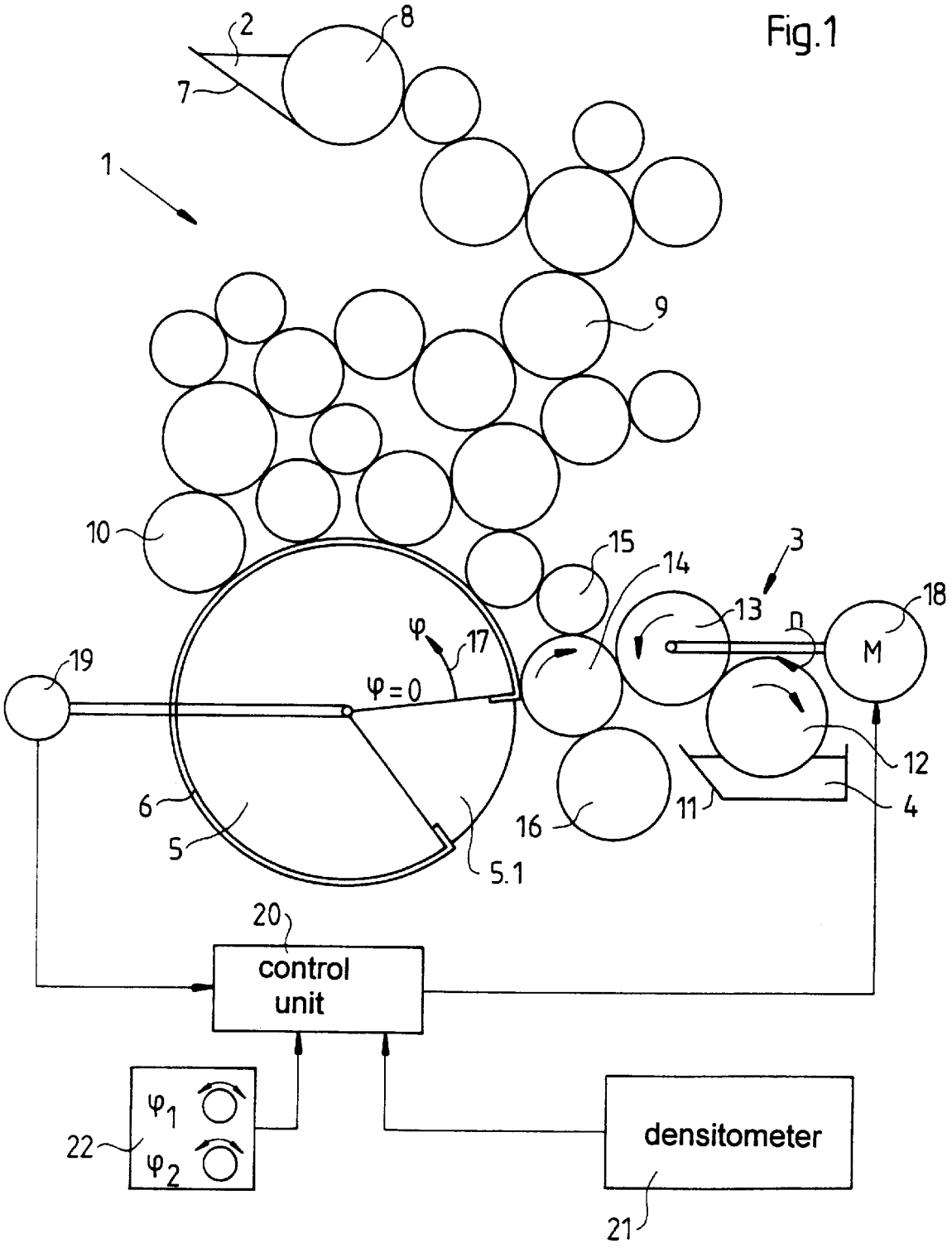
FIG. 1 is a diagrammatic and schematic view of an arrangement for performing the method of dampening a printing form in accordance with the invention.

Referring now to the drawings and, first, particularly to FIG. 1 thereof, there is shown therein part of a printing unit wherein an inking unit 1 for applying printing ink 2, and a dampening unit 3 for applying dampener or dampening fluid 4 to the surface of a printing form or plate 6 clamped on a form or plate cylinder 5 are provided. The inking unit includes an ink duct 7 and an ink duct roller 8 dipping into the printing ink 2. As viewed in the direction of ink flow, the ink duct roller 8 is followed by a series of ink transfer rollers 9 and ink applicator rollers 10. The ink applicator rollers 10 roll directly on the surface of the printing plate 6. Ink metering elements are provided in the ink duct 7 for varying, in the axial direction of the plate cylinder 5, the thickness of the printing-ink film applied to the printing plate 6. The dampening unit 3 includes a supply container 11 for the dampener 4, a dip roller 12, a metering roller 13, and a dampener applicator roller 14 for applying the dampener 4 to the surface of the printing plate 6. A distributor roller 15 connects the inking unit 1 to the dampening unit 3. If necessary, the distributor roller 15 can be pivoted out of the way, so that the inking and dampening units are separated, which can render the dampener control more effective. A dampener distributor roller 16 disposed in engagement with the dampener applicator roller 14 produces a more uniform film of dampener on the dampener applicator roller 14.

The inking unit is driven in synchronism with the plate cylinder 5 in a direction represented by a curved arrow 17. To avoid soiling, the rotary speed or rpm of the dampener applicator roller 14 may be approximately 10% lower than that of the plate cylinder 5. The metering roller 13 is coupled to a motor 18 and can be driven together with the dip roller 12 independently of all the other rollers in the printing unit. The rotary-angle position of the plate cylinder 5 is detected continuously by a rotary-angle encoder 19. The rotary-angle encoder 19 is connected to a control unit 20 for the rotary speed or rpm of the motor 18. The control unit 20 is connected to a densitometer 21, which furnishes density values over the length L of the sheet being printed. Also connected to the control unit 20 is an adjusting device 22, with which the characteristic performance over time, and particularly the duration of changes in rotary speed or rpm of the motor 18, can be adjusted by hand.

Figure 2:
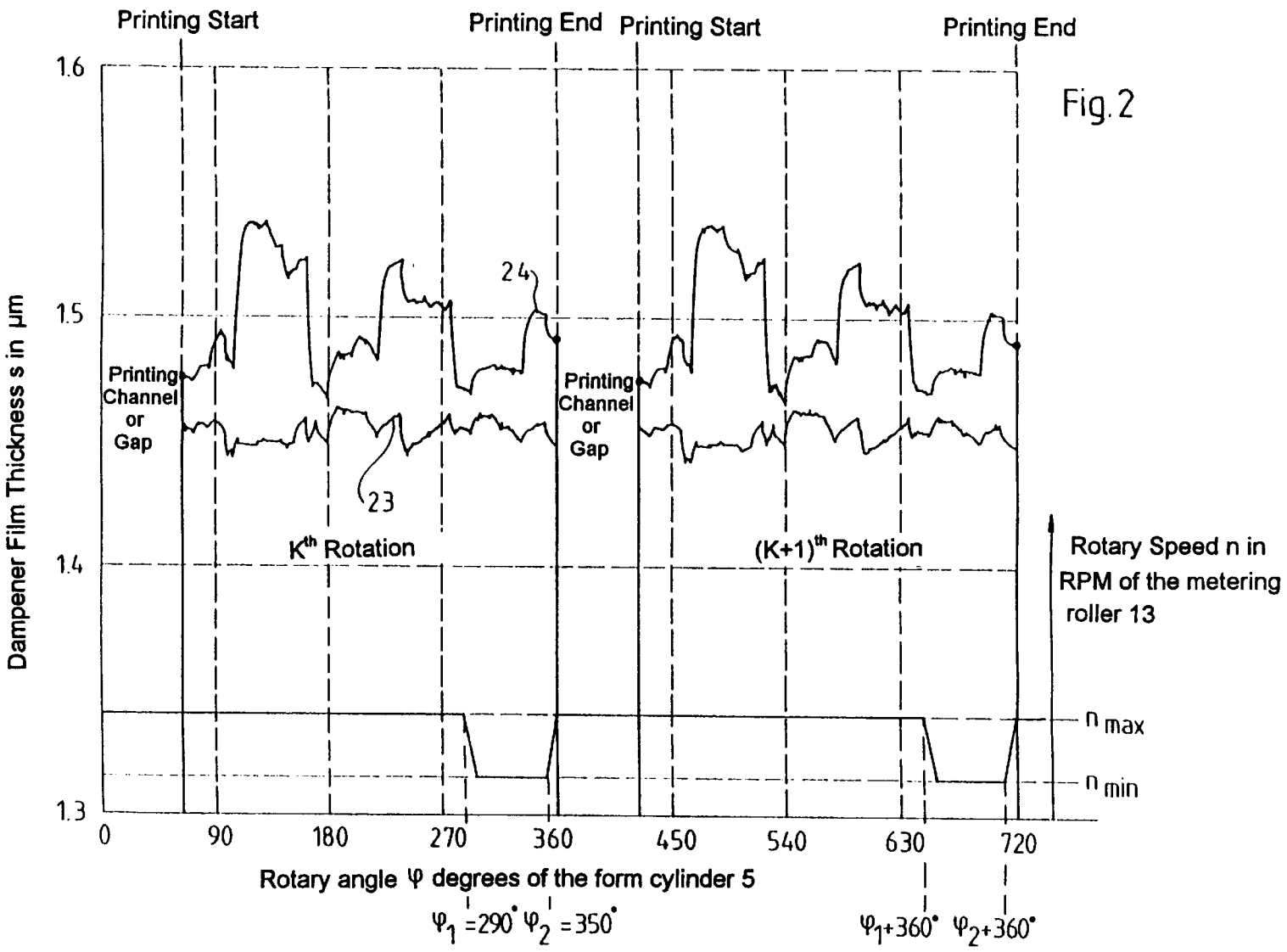
FIG. 2 is a plot diagram, over two revolutions of a plate cylinder, showing how the rotary speed of the metering roller is adjustable as a function of the rotary angle of the plate cylinder or of the channel or gap thereof so as to achieve a desired film thickness of the dampener or dampening fluid on the surface of the printing plate.

Referring to FIG. 2, there is hereinafter described in greater detail how the method can be performed with the apparatus described hereinbefore: In the plot diagram of FIG. 2, there is shown, for a period of two revolutions of the plate cylinder 5, how the rotary speed or rpm of the metering roller 13 should be adjusted, as a function of the rotary angle $\phi$ of the plate cylinder 5 and of the channel or gap 5.1, respectively, so as to achieve a desired film thickness s of the dampener on the surface of the printing plate 6 downstream from the dampener applicator roller 14. The position of the plate cylinder 5 shown in FIG. 1 corresponds to the 0 position shown in FIG. 2. Beginning at the 0 position, the plate cylinder 5 rotates in the direction represented by the arrow 17. At $\phi=360°$, the plate cylinder 5 has completed one complete revolution. In the angle range from 0 to $\phi_1 \approx 290°$, the rpm n of the metering roller 13 is kept at a constant value $n_{max}$. When the angle position $\phi_1 \approx 290°$ has been reached, the rpm n of the metering roller 13, with the aid of the control unit 20 and the motor 18, is then rapidly lowered to a value $n_{min}$. The rpm $n_{min}$ is maintained until a rotary angle value $\phi_2 \approx 350°$ is reached. The range between $\phi_1$ and $\phi_2$ on the printing plate 6 essentially corresponds to a completion of the printing of an image. From the rotary angle value $\phi_2$ on, the rpm n is quickly raised to the value $n_{max}$. Curve 23 indicates the effect resulting from the periodic rpm reduction. The film thickness s of the dampener on the surface of the printing plate 6 is substantially constant. The uniform distribution of dampener produces a flawless printed image. Curve 24 indicates the course that would result for the dampener film thickness s without the periodic rpm reduction. Curve 24 shows spikes at some points, which correspond to overdampened regions on the surface of the printing plate 6. In the printed image, there would be a marked dropoff in ink density in these regions, which would be visually apparent in the form of stripes. The transitions between the rpm values $n_{min}$ and $n_{max}$ are not abrupt but rather are so gradual that no rpm-dependent striping in the printed work will occur.

A possible manner of varying the rpm of the metering roller 13 periodically during each revolution of the plate cylinder 5 is achieved by taking into account the distribution of ink film thickness in the printed image. Each printed image has its own ink film thickness distribution in the printing direction, and this distribution can be measured. As FIG. 1 shows, a densitometer 21 for the printed image is connected to the control unit 20 and furnishes data on the ink density D in the printed image. In the curve for the density $D=f(\phi)$ shown in FIG. 3*b*, a density spike due to a lack of dampener occurs each time at the onset $\phi_A$ of the printed image, especially in screen tints. Depending upon the performance or development conditions in the dampening unit 3 with regard to the printing plate 6, the rpm of the metering roller 13 is raised, with the aid of the control unit 20, to a value $n_A$ with a time offset from the ink density spike at the onset of printing $\phi_A$. As a consequence thereof, the lack of dampener at the onset of printing is compensated for, thus resulting in the curve of the density $D=f(\phi)$ shown in the dot-dash or phantom lines in FIG. 3*b*.

Hereinafter is an explanation of the operation of the control unit 20: The control unit 20 has as its objective to vary the rotary speed or rpm of the dampening unit 3 within each revolution or rotation of the plate or form cylinder 5 so that, based upon a uniform dampener distribution on the printing plate or form 6, an ink thickness profile which is also as uniform as possible is produced on the printing sheet.

The control unit 20 is made up of a commercially available computer system with three inputs and one output. The computer system receives information from a rotary-angle encoder 19, a densitometer 21 and adjustment devices 22 through the three inputs, respectively. The computer system evaluates the information from the inputs and calculates therefrom the the periodic course of the rotary speed for the dampener unit 3. A period is related to a revolution of the plate or form cylinder 5. The course of the rotary speed is provided at at the output of the control unit 20 and controls the motor 18.

Figure 3A:
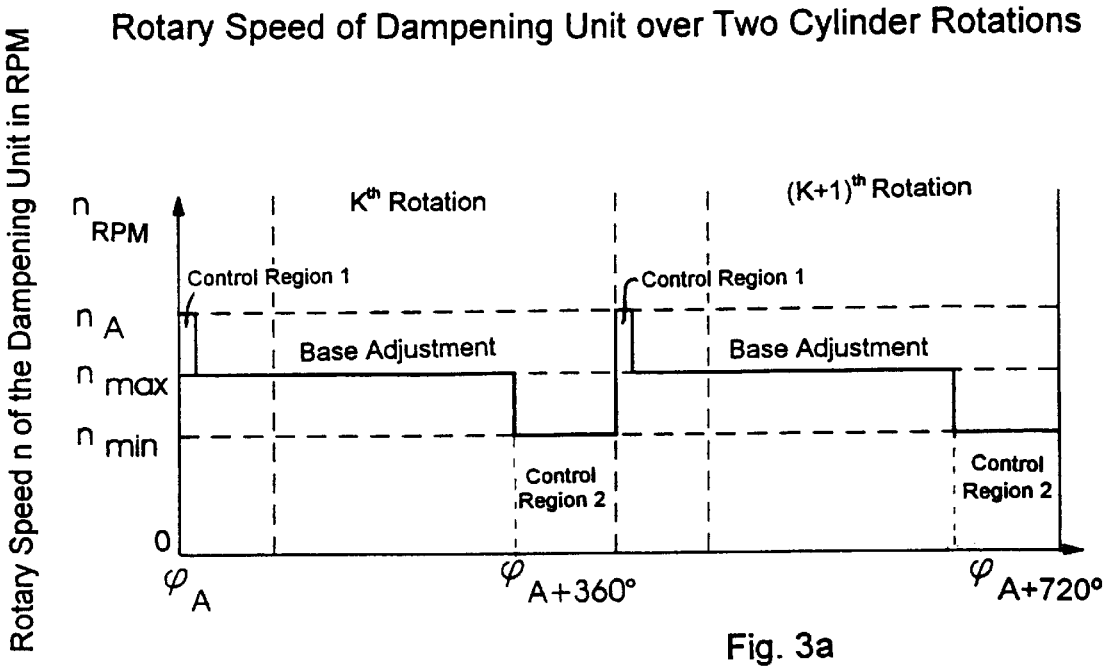
FIGS. 3*a* and 3*b* are plot diagrams of the rotary speed of the metering roller of the dampening unit and the ink density, respectively, over two revolutions of the metering roller.
Figure 3B:
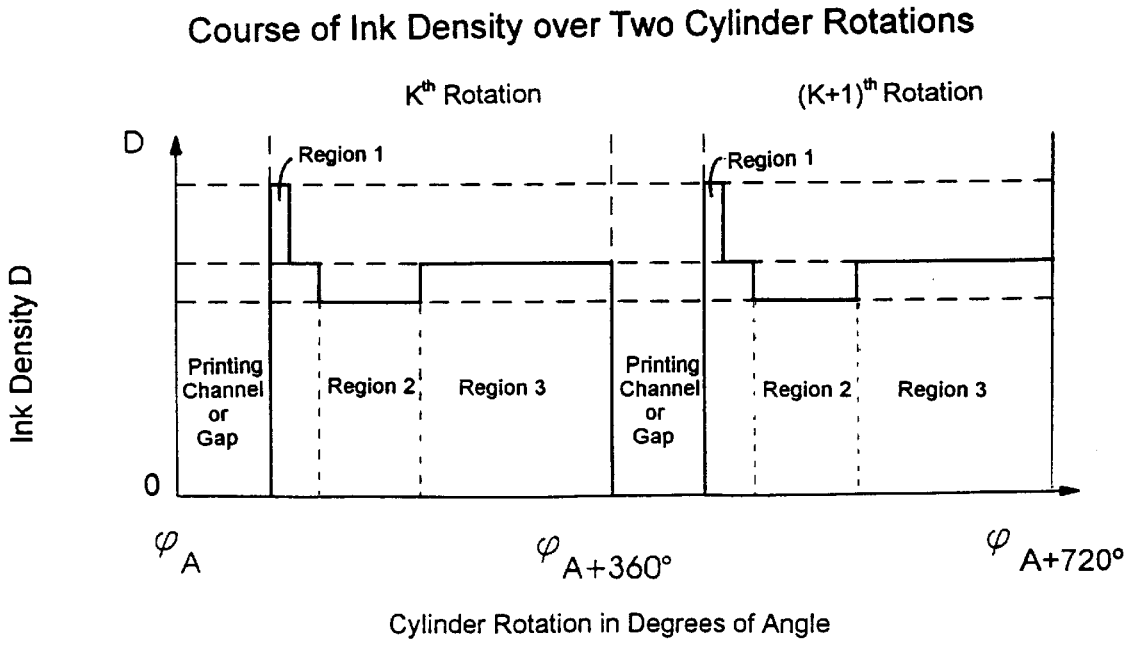

An evaluation of the course of the density by the computer system follows hereinafter with reference to FIGS. 2, 3*a* and 3*b:*

1. The control device receives the actual ink density profile of the printed sheet in the printing direction from the densitometer 21.
2. The computer system subdivides the ink density profile into, for example, three prescribed regions or ranges, namely,
   Region 1: Printing start (approximately 30 mm);
   Region 2: Channel or gap rolling of the dampener applicator roller; and
   Region 3: From the end of Region 2 to the printing end.
3. In accordance with the ink density profile, the course of the rotary speed is also subdivided into three regions, hereinafter referred to as control regions. With respect to the rotation of the form or plate cylinder 5, these control regions are displaced over a given angle to the ink density regions.
4. The computer system evaluates the the three regions of the ink density profile, in that it initially calculates the average or mean density values.
5. The average or mean density values of the Region 3 is defined as the nominal or setpoint density by the computer system.
6. The computer system compares the average or mean density values of Regions 1 and 2, respectively, with the nomial or setpoint density.
7. The following different cases result from the comparison for the Region 1:
   Case 1: The regional mean or average value of the density is outside a prescribed tolerance and greater than the nominal or setpoint value. With this result, the control unit 20 increases the rotary speed or rpm of the dampener unit 3 in the Control Region 1 a given amount with respect to the base adjustment or setting.
   Case 2: The regional mean or average value of the density is outside a prescribed tolerance and smaller than the nominal or setpoint value. With this result, the control unit 20 lowers the rotary speed or rpm of the dampener unit 3 in the Control Region 1 a given amount with respect to the base adjustment or setting.
   Case 3: The regional mean or average value is within a prescribed tolerance. With this result, no change in the rotary speed or rpm of the dampener unit 3 occurs in the Control Region 1. The procedure for the Region 2 follows in the same manner for the Region 1.

The computer system receives the information regarding the actual position of the form or plate cylinder 5 from the rotary-angle encoder 19 and adjusts the course of the rotary speed or rpm to this position.

The characteristic curve or course of the rotary speed or rpm can be manually influenced via the adjustment devices 22. The computer system receives the actual values of the adustment devices from the respective input. Upon a deviation from a prescribed base adjustment or setting, the extent of the variations in the rotary speed or rpm (note the case differences above) and the duration of the control regions, respectively, are suitably adjusted.

We claim:

1. A method for dampening a printing form carried by a form cylinder having a channel or gap which comprises using a metering roller to transfer dampening fluid to a damper applicator roller and adjusting the RPM of the metering roller in accordance with the rotary angle of the channel or gap of the form cylinder during each revolution of the form cylinder.

2. The method according to claim 1, which includes rotating the metering roller with maximum rpm in the region of the printing form corresponding to the beginning of printing of a printed image, and with a minimum rpm in a region of the printing form located upstream of the channel or gap in the direction of rotation of the form cylinder.

* * * * *